United States Patent [19]

Karp

[11] 4,189,100

[45] Feb. 19, 1980

[54] FLUID DISPENSER FOR A SHOWER BATH

[76] Inventor: Erich Karp, 3608-B Lighthouse Way, New Port Richey, Fla. 33552

[21] Appl. No.: 914,380

[22] Filed: Jun. 12, 1978

[51] Int. Cl.[2] ..... B05B 7/26

[52] U.S. Cl. ..... 239/310; 251/309

[58] Field of Search ..... 239/302, 310, 318; 251/309; 222/145, 193

[56] References Cited

U.S. PATENT DOCUMENTS

| | | | |
|---|---|---|---|
| 1,103,786 | 7/1914 | Lewis | 239/310 |
| 2,672,366 | 3/1954 | Deport | 239/310 |
| 3,160,387 | 12/1964 | Windsor | 251/309 |
| 3,539,111 | 11/1970 | Johnson | 239/318 |
| 3,567,177 | 3/1971 | Mueller | 251/309 |
| 3,612,404 | 10/1971 | Vicari | 239/310 |
| 4,055,324 | 10/1977 | Hughes et al. | 251/309 |

*Primary Examiner*—H. Grant Skaggs
*Attorney, Agent, or Firm*—Stanley M. Miller

[57] ABSTRACT

An improved fluid dispenser for a shower bath is disclosed for mounting between a pressurized water pipe and a shower nozzle. The dispenser includes a body portion having a water channel connected between the pipe and the nozzle and a dispensing channel opening into the water channel at a lower end thereof and opening onto an upper surface of the body at an upper end thereof above the water channel. A fluid reservoir is mounted on top of the upper surface of the body, having a drain opening into the dispensing channel, for storing the fluid to be dispensed. A valve seat composed of a high lubricity fluorocarbon resin is mounted in the dispensing channel, having a hole therethrough communicating between the upper end of the dispensing channel and a lower surface of the valve seat. A cylindrical valve composed of a high lubricity fluorocarbon resin is rotatably mounted horizontally in the body with a circumferential surface in sealable contact with the lower surface of the valve seat. A transverse hole passes through the cylindrical valve, which selectively communicates between the lower end of the dispensing channel and the hole in the valve seat in response to axially rotating the cylindrical valve in the body. In this manner, a leakless fluid dispensing valve is provided for the shower bath dispenser.

7 Claims, 4 Drawing Figures

SEC. B-B'

SEC. A-A'

FLUID DISPENSER FOR A SHOWER BATH

FIELD OF THE INVENTION

The invention broadly relates to shower bath appliances and more particularly relates to an improvement in a fluid dispenser for a shower bath.

BACKGROUND OF THE INVENTION

The shower bath has an ancient history, with paintings on ancient Greek vases showing that there were shower baths employing advanced systems of water supply and drainage by the fifth century, B.C. In Roman times, the bather was anointed with oil before his bath to reduce the tendancy of the skin to dry out after bathing. The shower bath has survived into modern times and has become so common in usage that bathrooms in domestic households generally include a shower nozzle mounted from the wall above the bathtub. The practice of anointing the body with a bath oil is relatively easy when tub bathing is practiced since the oil can be mixed with the water in the tub. However, for shower bathing, the body must be separately anointed prior to entering the shower. The prior art has addressed this problem by providing a gravity fed fluid dispenser which mounts behind the nozzle in a shower bath, into which bath oil may be introduced. The prior art dispenser has a valve which meters the bath oil fluid into the shower water stream, thereby providing the bather with a shower stream which is a mixture of water and the bath oil. A significant problem, however, has confronted the prior art shower bath fluid dispensers. The bath oil, when mixed with water, has a relatively low surface tension, making the prior art dispensers very prone to fluid leakage around their metering valves. This promotes the fouling of the valve mechanism and the wastage of the bath oil fluid.

OBJECTS OF THE INVENTION

It is therefore an object of the invention to provide an improved shower bath fluid dispenser.

It is another object of the invention to provide a shower bath fluid dispenser having a metering valve which does not leak.

It is still a third object of the invention to provide an improved fluid dispenser for a shower bath which has a lower manufacturing cost and includes a leakless metering valve.

SUMMARY OF THE INVENTION

These and other objects, features and advantages of the invention are provided by the improved fluid dispenser for a shower bath disclosed herein.

An improved fluid dispenser for a shower bath is disclosed for mounting between a pressurized water pipe and a shower nozzle. The dispenser includes a body portion having a water channel connected between the pipe and the nozzle and a dispensing channel opening into the water channel at a lower end thereof and opening onto an upper surface of the body at an upper end thereof above the water channel. A fluid reservoir is mounted on top of the upper surface of the body, having a drain opening into the dispensing channel, for storing the fluid to be dispensed. A valve seat composed of a high lubricity fluorocarbon resin is mounted in the dispensing channel, having a hole therethrough communicating between the upper end of the dispensing channel and a lower surface of the valve seat. A cylindrical valve composed of a high lubricity fluorocarbon resin is rotatably mounted horizontally in the body with a circumferential surface in sealable contact with the lower surface of the valve seat. A transverse hole passes through the cylindrical valve, which selectively communicates between the lower end of the dispensing channel and the hole in the valve seat in response to axially rotating the cylindrical valve in the body. In this manner, a leakless fluid dispensing valve is provided for the shower bath dispenser.

DESCRIPTION OF THE FIGURES

These and other objects, features and advantages of the invention will be more fully appreciated with reference to the accompanying figures.

DISCUSSION OF THE PREFERRED EMBODIMENT

Figure 1:
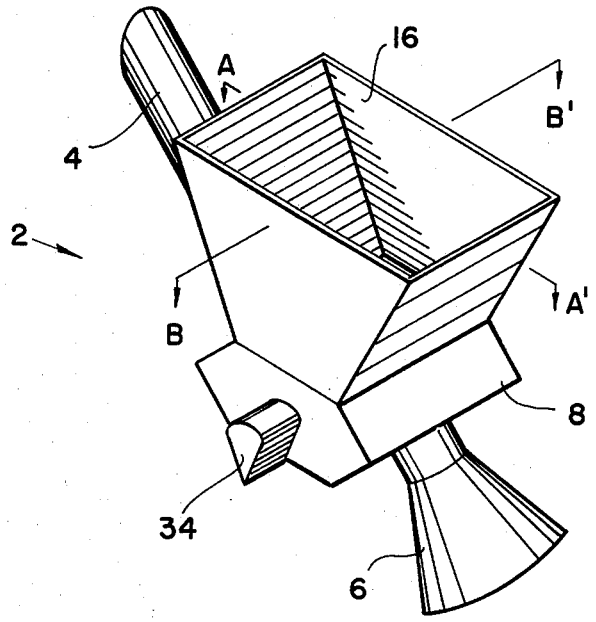
FIG. 1 is an overall view of the improved fluid dispenser for a shower bath.
Figure 3:
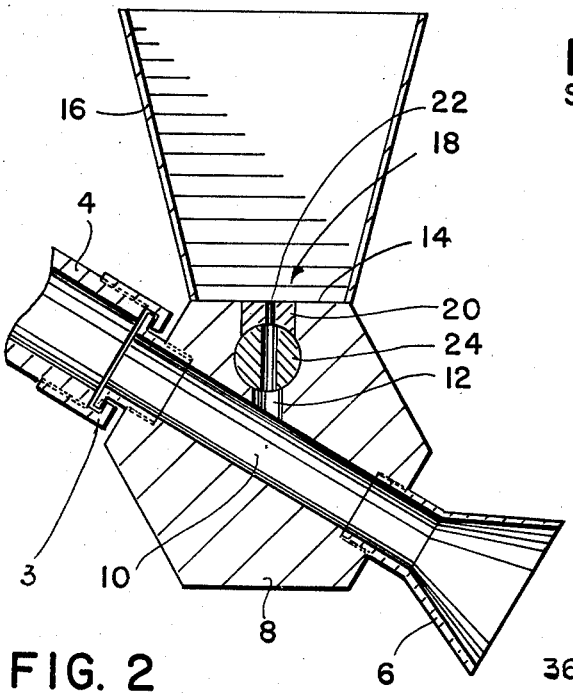
FIG. 3 is a cross-sectional view along the section line B—B' of the dispenser of FIG. 1.
Figure 2:
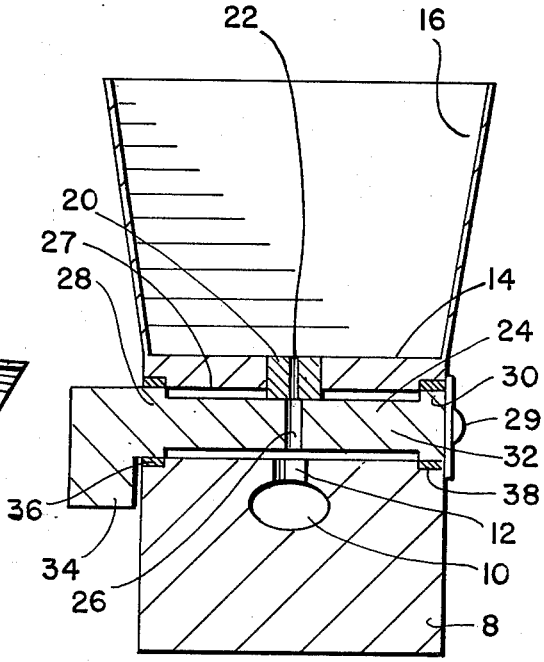
FIG. 2 is a cross-sectional view along the section line A—A' of the dispenser of FIG. 1.

The improved fluid dispenser for a shower bath shown in FIG. 1 and in cross-section in FIGS. 2 and 3, provides a leakless fluid dispensing valve which does not foil or promote wastage of the bath fluid stored therein. The fluid dispenser 2 mounts between a pressurized water pipe 4 and a shower nozzle 6. A body portion 8 has a water channel 10 connected between the pipe 4 and the nozzle 6. The body portion 8 has a dispensing channel 12 which opens into the water channel 10 at a lower end thereof and opens onto an upper surface 14 of the body 8 at an upper end thereof above the water channel 10.

A fluid reservoir 16 is mounted on top of the upper surface 14 of the body portion 8 and has a drain opening 18 which opens into the dispensing channel 12, for storing fluid to be dispensed, such a bubble bath, deoderant bath oil, foaming bath oil or other types of bath oils. Such oils are conventionally designed to eliminate the usual dry feel to the skin after a normal shower and will also help eliminate a build-up of soap film around the shower stall itself, making clean-up easier. The invention requires no extra plumbing or special tools to install. The existing shower head is removed and the dispenser 2 is mounted by means of a connecting nut 3 to the threaded water pipe 4. The threaded nozzle 6 then screws into the lower portion of the water channel 10. This lowers the nozzle 6 by less than 2 inches with respect to its initial position.

A valve seat 20 is composed of a high lubricity fluorocarbon resin. The valve seat 20 is mounted in the dispensing channel 12. The valve 20 has a hole 22 therethrough communicating between the upper end of the dispensing channel 12 and a lower surface 23 of the valve seat 20.

A cylindrical valve 24 is composed of a high lubricity fluorocarbon resin. The cylindrical valve 24 is rotatably mounted horizontally in the body portion 8 with a circumferential surface 25 in sealable contact with the lower surface 23 of the valve seat 20. A transverse hole 26 is located through the cylindrical valve 24, which selectively communicates between the lower end of the dispensing channel 12 and the hole 22 in the valve seat 20, in response to axially rotating the cylindrical valve 24 in the body 8. By this means, a leakless fluid dispensing valve is provided for the shower bath dispenser.

The high lubricity fluorocarbon resin may be polytetrafluoroethylene, fluoroinated ethylenepropylene, chlorotrifluoroethylene, or polyvinylidene fluoride. These fluorocarbon resins are all thermoplastics having the properties of inertness to most materials, resistance to high and low temperatures, essentially zero moisture absorption, low coefficient of friction, and high resistance to oxidation. Polytetrafluoroethylene has a low coefficient of friction comparable to ice against ice. Few materials will stick to its slippery surface. It has virtually a zero water absorption characteristic. The techniques of processing polytetrafluoroethylene are unlike those for conventional thermoplastics due to its very high melt viscosity. The resin undergoes a transition from a powder to a gel state and is therefore processed with techniques similar to those employed in powdered metallurgy, by cold-forming a preform from the powder at pressures from between 2,000 to 10,000 p.s.i. and then sintering the preform in a mod under pressure at between 650° and 750° F. The valve seat 20 and the cylindrical valve 24 may be made by this technique. The body portion 8 may also be composed of polytetrafluoroethylene with the valve seat 20 formed as an integral part of the body by this technique.

Figure 4:
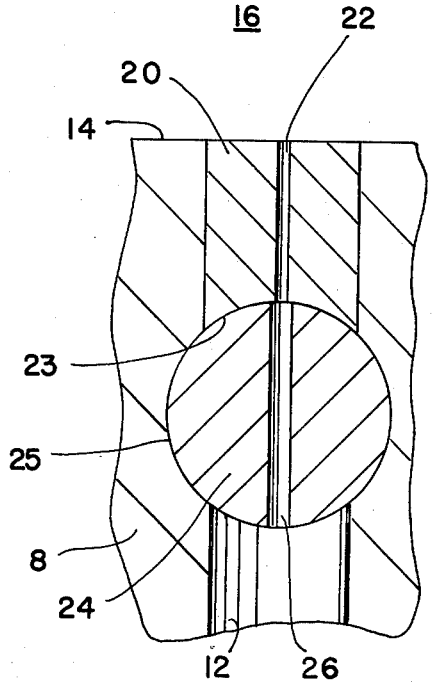
FIG. 4 is a cross-sectional view of the valve seat.

As may be seen in FIG. 4, the valve seat 20 may have its lower surface 23 shaped with a concave arcuate, cylindrical contour which mates with the convex cylindrical contour of the circumferential surface 25 of the cylindrical valve 24, so that the fluid seal between the valve seat 20 and the valve 24 is improved. The valve seat 20 may have its outer cylindrical surface threaded so that it may be screwed into place with mating threads in the dispensing channel 12.

The valve 24 is rotatably mounted in a cylindrical hole 27 in the body portion 8. The cylindrical valve 24 terminates at a first end 28 and at an opposite second end 30, both of which have transverse diameters which are larger than the diameter of the valve 24 in the central portion 32 between the first end 28 and the second end 30. The first end 28 and the second end 30 of the valve 24 are in bearing contact with the walls of the cylindrical hole 27 in the body 8. In this manner, the circumferential surface 25 of the valve 24 in the central portion 32, is supported by the first end 28 and second end 30 of the valve 24 out of contact with the walls of the cylindrical hole 27 in the body portion 8, so as to prevent abrading the circumferential surface 25 in the central portion 32 of the valve 24. This contributes to a longer life for the valve. A screw and washer 29 may be fastened into the end 30 of valve 24 to prevent axial movement of the valve.

A handle portion 34 is mounted to the first end 28 of the valve 24, for enabling the manual rotation of the valve 24 within the body 8. In this manner, the amount of fluid to be dispensed into the water channel 10 from the reservoir 16 may be closely controlled.

The hole 22 through the valve seat 20 may have a diameter of approximately 0.070 inches. The transverse hole 26 through the valve 24 may have a diameter of approximately 0.093 inches.

The first end 28 and second end 30 of the valve 24 are in rotatable sealing engagement with the walls of the cylindrical hole 27 through the body 8. In this manner, pressurized water in the water channel 10 will not flow backward past the first and second ends of the valve.

The body 8 may further include a first cylindrical, annular bushing 36 and a second cylindrical, annular bushing 38 composed of a fluorocarbon resin such as polytetrafluoroethylene. The first bushing 36 and the second bushing 38 are mounted at opposite ends of the cylindrical hole 27 in the body 8, for forming a bearing and sealing engagement with the first end 28 and the second end 30 of the valve 24. In this manner, the valve 24 will more freely rotate within the body 8.

The body 8 may be molded or machined from plastic or a metal such as aluminum or other similar materials, as well as being molded from a fluorocarbon resin as was mentioned above. By making the sides of the reservoir 16 translucent or transparent, the level of fluid in the reservoir can be more readily seen. A manual pump and fluid supply may be connected to the reservoir 16 to refill the reservoir with fluid when needed. The resulting improved fluid dispenser for a shower bath provides a leakless fluid dispensing valve for reduced leakage and cleaner operation.

Although a specific embodiment of the invention has been disclosed herein, workers of skill in the art would agree that minor changes can be made in the structure and composition of the elements thereof without departing from the spirit and scope of the invention.

What is claimed is:

1. An improved fluid dispenser for a shower bath, for mounting between a pressurized water pipe and a shower nozzle, comprising:

a body portion having a water channel connected between said pipe at an upper end and said nozzle at a lower end, and a dispensing channel opening into said water channel at an intermediate point between said upper end and said lower end thereof and opening into an upper surface of said body at the upper end thereof above said water channel;

a fluid reservoir mounted on top of said upper surface of said body portion, having a drain opening into said dispensing channel, for storing fluid to be dispensed;

a valve seat composed of a high lubricity fluorocarbon resin mounted in said dispensing channel having a hole therethrough communicating between said upper end of said dispensing channel and a lower surface of said valve seat;

a cylindrical valve composed of a high lubricity fluorocarbon resin, rotatably mounted horizontally in said body portion with a circumferential surface in sealable contact with said lower surface of said valve seat, having a transverse hole therethrough which selectively communicates between said lower end of said dispensing channel and said hole in said valve seat in response to axially rotating said cylindrical valve in said body;

said valve being rotatably mounted in a cylindrical hole in said body portion;

said cylindrical valve terminating at a first and second opposite ends, having transverse diameters which are larger than the diameter of said valve in the central portion between said first and second ends;

said first and second ends of said valve being in bearing contact with said cylindrical hole in said body;

said circumferential surface of said valve in said central portion being supported by said first and second ends of said valve out of contact with the walls of said cylindrical hole in said body portion, to prevent abrading said circumferential surface of said valve;

said lower surface of said valve seat having a concave arcuate contour which mates with the convex cylindrical contour of said circumferential surface of said cylindrical valve;

whereby the fluid seal provided by said valve is improved.

2. The apparatus of claim 1, wherein said high lubricity fluorocarbon resin is selected from the group consisting of polytetrafluoroethylene, fluorinated ethylene-propylene, chlorotrifluoroethylene, and polyvinylidene fluoride.

3. The apparatus of claim 1, wherein said valve further comprises:

a handle portion mounted on said first end of said valve, for enabling the manual rotation of said valve in said body;

whereby the amount of fluid to be dispensed into said water channel may be controlled.

4. The apparatus of claim 3, wherein said valve seat further comprises:

said hole through said valve seat having a diameter of approximately 0.070 inches.

5. The apparatus of claim 4, wherein said valve further comprises:

said transverse hole through said valve having a diameter of approximately 0.093 inches.

6. The apparatus of claim 1, wherein said valve further comprises:

said first and second ends of said valve being in rotatable sealing engagement with the walls of said cylindrical hole in said body;

whereby pressurized water in said water channel will not flow backward past said first and second ends of said valve.

7. The apparatus of claim 6, wherein said body further comprises:

first and second cylindrical bushings composed of polytetrafluoroethylene, mounted in said cylindrical hole in said body in bearing and sealing engagement with said first and second ends of said valve;

whereby said valve more freely rotates in said body.

* * * * *